US007658383B1

(12) United States Patent
Salansky

(10) Patent No.: US 7,658,383 B1
(45) Date of Patent: Feb. 9, 2010

(54) GAMING DEVICE

(76) Inventor: Charles Salansky, 710 Tacoma Ave., Buffalo, NY (US) 14216

( * ) Notice: Subject to any disclaimer, the term of this patent is extended or adjusted under 35 U.S.C. 154(b) by 0 days.

(21) Appl. No.: 12/317,525

(22) Filed: Dec. 23, 2008

(51) Int. Cl.
*A63D 3/02* (2006.01)

(52) U.S. Cl. ..... 273/118 R; 473/73

(58) Field of Classification Search ..... 273/108, 273/108.1, 118 R, 118 A, 119 R, 119 A, 121 R, 273/121 A, 122 R, 122 A; 473/54, 57, 73, 473/74, 83, 102, 103, 115, 116
See application file for complete search history.

(56) References Cited

U.S. PATENT DOCUMENTS

| | | | | | |
|---|---|---|---|---|---|
| 2,541,583 | A | * | 2/1951 | Hayden | 473/107 |
| 2,565,584 | A | * | 8/1951 | Armstrong | 473/116 |
| 2,610,055 | A | * | 9/1952 | Goodyear | 473/109 |
| 3,602,507 | A | * | 8/1971 | Naylor | 473/116 |
| 3,857,562 | A | * | 12/1974 | Rardon et al. | 473/107 |
| 4,790,535 | A | | 12/1988 | Droske | |
| 4,817,945 | A | | 4/1989 | Ferguson | |
| 5,011,147 | A | | 4/1991 | Thomas et al. | |
| 5,039,095 | A | | 8/1991 | Buckley | |
| 5,071,127 | A | | 12/1991 | Bromley | |
| 5,183,261 | A | | 2/1993 | Nobi | |
| 5,556,341 | A | | 9/1996 | Bonn | |
| 5,630,761 | A | | 5/1997 | Anderson et al. | |
| 5,655,768 | A | * | 8/1997 | Moret et al. | 273/108.5 |
| 5,772,204 | A | | 6/1998 | Phelps | |
| 5,785,313 | A | * | 7/1998 | Shiraishi | 273/108.1 |
| 6,319,144 | B1 | | 11/2001 | Hasty | |
| 6,358,155 | B1 | | 3/2002 | Huhne | |
| 6,524,192 | B1 | | 2/2003 | Tsujita et al. | |

* cited by examiner

*Primary Examiner*—Raleigh W. Chiu
(74) *Attorney, Agent, or Firm*—Simpson & Simpson, PLLC

(57) ABSTRACT

A gaming device including a playing field having a substantially planar surface, and a target setter arranged to pivot relative to the playing field between a first position and a second position, the target setter including a reservoir and at least one channel extending from the reservoir, wherein the reservoir is adapted to receive and store at least one substantially spherical object therein when the target setter is in the first position, and the at least one channel is operatively arranged to direct a substantially spherical object from the reservoir to the playing field when the target setter is in the second position.

20 Claims, 12 Drawing Sheets

GAMING DEVICE

FIELD OF THE INVENTION

The invention broadly relates to carom games, such as bowling, billiards, and marbles, and more particularly to table-top or arcade-style versions of such games.

BACKGROUND OF THE INVENTION

Carom games are well-known and have existed in various forms for thousands of years. Examples of such games include bowling, billiards, bocce, carom, skittles, and marbles, the latter having been played in ancient Egypt and Greece. Generally, a carom game includes one or more target objects arranged upon a substantially planar, often horizontal, surface, and a player must strike the target objects with a projectile. As the name suggests, the target objects are arranged to strike and rebound off each other, i.e., carom, when struck by the projectile. The objective for striking the target objects depends upon the particular carom game.

In bowling, the objective is to knock down a plurality of target objects arranged on an elongated playing field, called a "bowling lane", by rolling a heavy ball down the bowling lane into the target objects. The target objects, which are called "bowling pins" or simply "pins", vary in shape depending on the particular bowling game. In general, however, a pin is an elongated, substantially cylindrical object having a planar bottom surface, which allows it to stand upright on the playing surface. The pins are usually arranged in rows and in a particular formation, such as a triangle. Due to their cylindrical shape, pins which are knocked over during the game do not always roll off the playing field and tend to remain thereon. Such pins obstruct play and must be removed from the playing field in order to continue the game. Originally, prior to the advent of automation, pins which were knocked over were cleared off the playing field and reset by hand.

Presently, such clearing and resetting is performed by various machines which, by means of elaborate and complex components, sweep the pins from the playing field, collect the swept pins and the ball, reset the pins on the playing field, and return the ball to the player. One of the most common examples of such a machine comprises an arm, which sweeps the pins from the playing field, a shaking board or "shaker", which receives the swept pins and ball and transfers the ball and pins to the rear of a pit arranged behind the lane by means of violent vibration. The machine further comprises two large spinning wheels, namely, a ballwheel and a pin-wheel. The ball wheel lifts the ball up to two lift rods, which deposit it onto an underground metal track driven by an accelerator belt which carries the ball back toward the player, and two pulleys lift the ball and deposit it for the player. The pin-wheel comprises a plurality of pockets which are arranged to capture the pins. The shaker shakes the pins until they are all positioned within the pockets, and the pinwheel transfers the pins into a metal tray, which orients the pins. Subsequently, a conveyor belt lifts the pins, and the pins slide into a metal basket called the "turret". The turret is operatively arranged to simultaneously drop the pins into a spotting table, which then lowers them onto the lane.

Clearly, such an elaborate machine is costly to manufacture, install, maintain, and repair. Additionally, building a scaled-down version of such a machine for a table-top version of the game may not be feasible.

As can be derived from the variety of devices and methods directed at setting targets on a playing field of a carom game, many means have been contemplated to accomplish the desired end. Heretofore, tradeoffs between the complexity of the devices and the scale of the game were required. Thus, there is a long-felt need for a gaming device for carom games which includes a simple means for collecting and setting a plurality of targets on the playing field.

BRIEF SUMMARY OF THE INVENTION

The present invention broadly is a gaming device including: a playing field having a substantially planar surface; and, a target setter arranged to pivot relative to the playing field between a first position and a second position, the target setter including a reservoir and at least one channel extending from the reservoir, wherein the reservoir is adapted to receive and store at least one substantially spherical object therein when the target setter is in the first position, and the at least one channel is operatively arranged to direct a substantially spherical object from the reservoir to the playing field when the target setter is in the second position.

In a further embodiment, the gaming device includes a receptacle arranged adjacent to and elevationally lower than the substantially planar surface, wherein the receptacle is operatively arranged to receive at least one substantially spherical objects from the playing field and direct at least one substantially spherical objects into the reservoir when the target setter is in the first position.

The embodiment of the present invention gaming device described herein is particularly adapted for a game which resembles a combination of bowling and billiards. It should be appreciated, however, that the described embodiment represents only a preferred embodiment, and the gaming device may be adapted for a wide variety of other games, especially games involving the striking of a plurality of targets arranged on a playing field, without departing from the scope or spirit of the invention.

Similar to bowling, the game to which the preferred embodiment is adapted involves rolling a ball down an elongated playing field at a plurality of targets, which are arranged as a tetractys, i.e., a triangular figure comprising ten points arranged in four rows, which consist of one, two, three, and four points, respectively. In addition, the described embodiment includes gutters extending along opposite longitudinal sides of the playing field, a receptacle arranged at one end of the playing field for collecting the rolled ball and the targets, and a target setter operatively arranged to receive the targets, preferably from the receptacle, and set them on the playing field in the tetractys formation. Unlike bowling, however, and more akin to a billiards game, each of the targets comprises a substantially spherical object.

It is a general object of the present invention to provide a gaming device adapted for carom games, which includes a simple means for collecting and resetting a plurality of targets on a playing field.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the terms "elevation", "elevational", and "elevationally" refer to height or vertical distance from an underlying level surface, such as, floor 10 shown in FIGS. 11-13. Accordingly, if a structure is described herein as being "elevationally higher" than another structure, then its vertical distance from an underlying level surface is greater than that of the other structure. Additionally, if a surface is described herein as being "inclined" or "declined", then at least two points on the surface are elevationally unequal, i.e., one point is higher than the other point. Thus, the term "elevation" is synonymous with terms such as "height" and "vertical distance", and such terms may be used interchangeably in the specification and claims. Although any methods, devices or materials similar or equivalent to those described herein can be used in the practice or testing of the invention, the preferred methods, devices, and materials are now described.

Figures 1, 2:
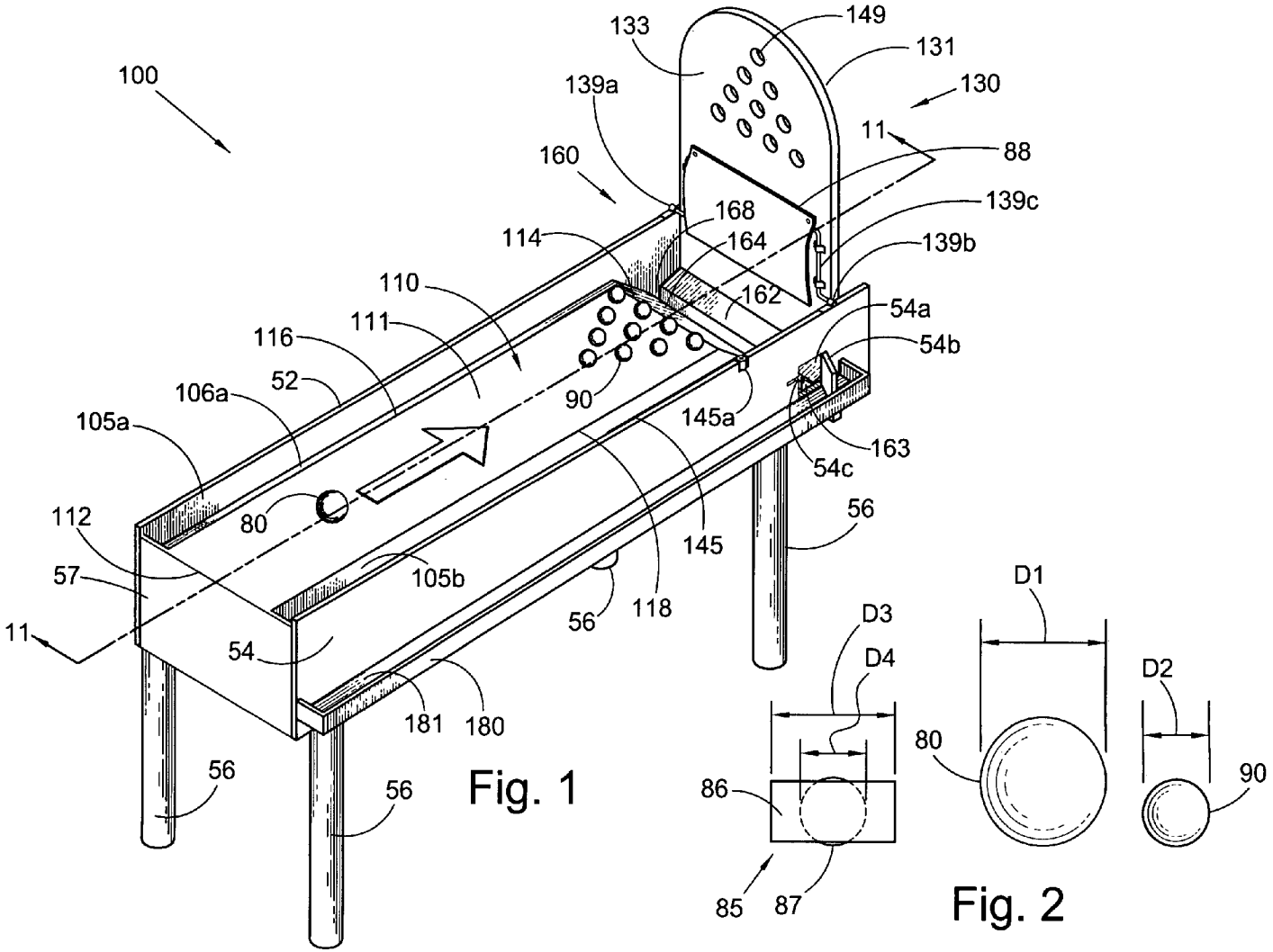
FIG. 1 is a front perspective view of the present invention gaming device comprising a playing field, a receptacle, and a target setter, showing a plurality of targets and a moving projectile on the playing field.
FIG. 2 is a front view of an embodiment of a projectile, an embodiment of a target and a further embodiment of a device used as either a projectile or target.

The following description is best understood in view of FIGS. 1-13. FIG. 1 is a perspective view of a preferred embodiment of gaming device 100, hereinafter simply referred to as gaming device 100. Broadly, gaming device 100 comprises playing field 110 and target setter 130, and may further comprise receptacle 160.

Gaming device 100 may include a housing which comprises front wall 57, left side wall 52, right side wall 54, and a plurality of legs 56. Left and right side walls, 52 and 54, are both fixed relative to playing field 110. As described in further detail infra, the target setter of the present invention is arranged to pivot, relative to the playing field, between a first position and a second position. To that end, target setter 130 is attached to left and right side walls, 52 and 54, by means of hinges 139*a* and 139*b*, respectively, and by means of connection rod 139*c*. Since left and right side walls, 52 and 54, are both fixed relative to playing field 110, and target setter 130 is hingedly connected to left and right side walls, 52 and 54, target setter 130 is arranged to pivot relative to playing field 110.

FIG. 1 also illustrates a game for which gaming device 100 is adapted, which involves a player (not shown) rolling projectile 80 along playing field 110 in order to strike a plurality of targets 90 arranged as a tetractys. As shown in FIG. 2, projectile 80 comprises a substantially spherical object having first diameter D1, and each target 90 comprises a substantially spherical object having a second diameter D2. In a preferred embodiment, D1 is greater than D2, so that projectile 80 and the plurality of targets 90 may be differentially sorted and directed by receptacle 160, as described in further detail infra. It should also be appreciated that other projectile and/or target devices may be used, e.g., object 85 comprising a puck-like portion 86 and internally captures spherical portion 87, and such variations are within the spirit and scope of the claimed invention. As can be seen from the figures, puck-like portion 86 is substantially cylindrical having an opening centrally disposed therethrough, and having spherical portion 87 disposed therein. Puck-like portion 86 has a cylinder diameter D3, spherical portion 87 has a spherical diameter D4, and spherical diameter D4 is less than cylinder diameter D3. Furthermore, as projectiles and targets may be moving at substantial rates of speed towards target setter 130, a damping means is included to slow such movement. In the embodiments shown in the figures, the damping means comprises rubber sheet 88; however it should be appreciated that other damping means are also possible, e.g., air encapsulated foam.

Playing field 110 includes substantially planar surface 111 having first end 112 and second end 114, which is arranged opposite first end 112. Planar surface 111 may be substantially horizontal, i.e., all points thereon are substantially elevationally equal. However, in a preferred embodiment, first end 112 is elevationally higher than second 114, so that planar surface 111 is operatively arranged to direct substantially spherical objects, such as projectile 80 and/or target 90, toward second end 114 by means of gravity. In other words, planar surface 111 preferably declines from first end 112 to second end 114, so that a substantially spherical object will roll from first end 112 toward second end 114. When receptacle 160 is included in gaming device 100, it is preferably arranged adjacent to and elevationally lower than second end 114, so that planar surface 111 is operatively arranged to direct a substantially spherical object from first end 112 to second end 114 and into receptacle 160.

Figure 5:
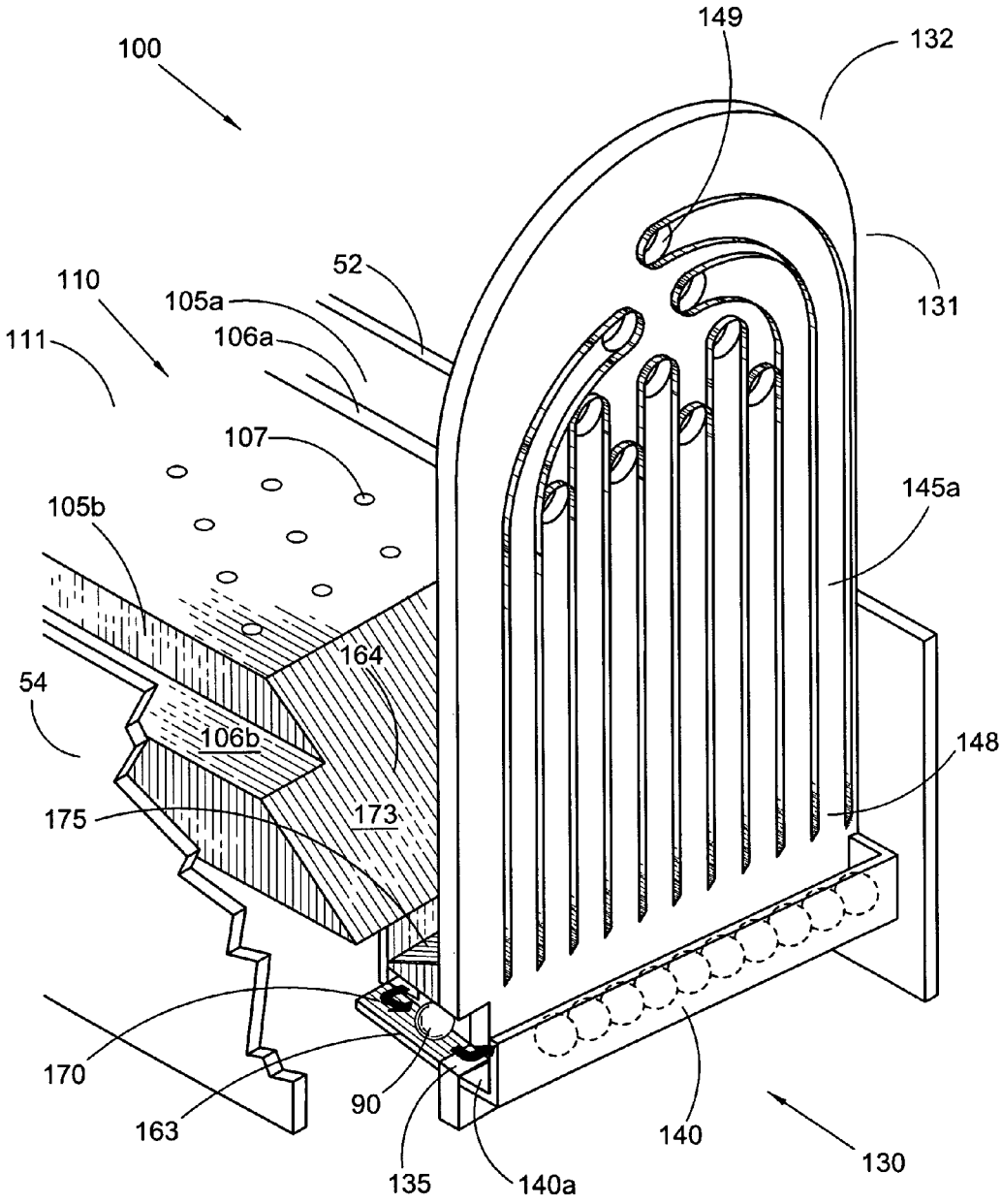
FIG. 5 is a back, partial perspective, cutaway view of the gaming device and target shown in FIG. 4, showing the plurality of targets aligning within the reservoir.
Figure 7:
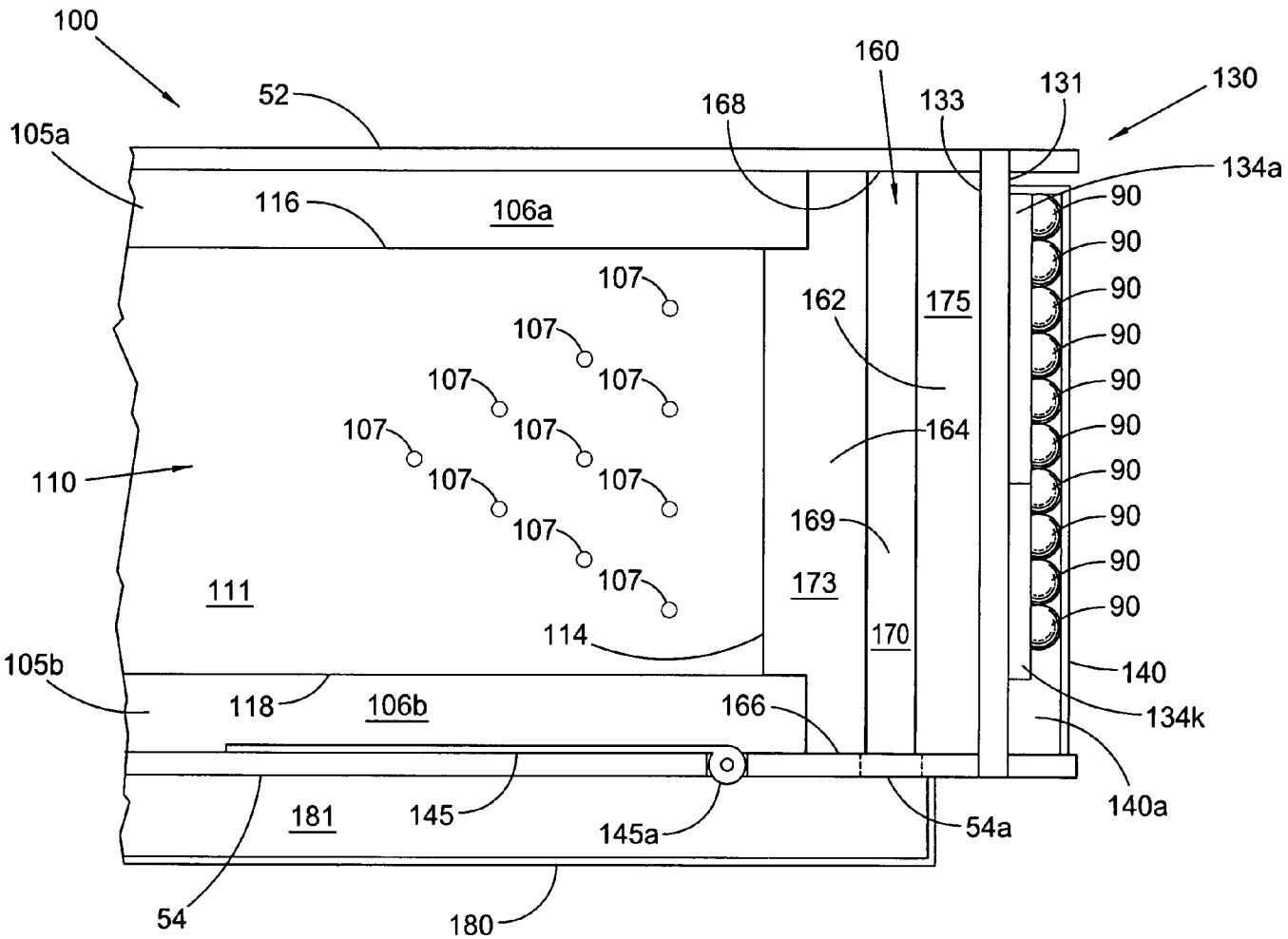
FIG. 7 is a partial top view of the gaming device, showing the target setter in the first position with the plurality of targets within its reservoir.
Figure 8:
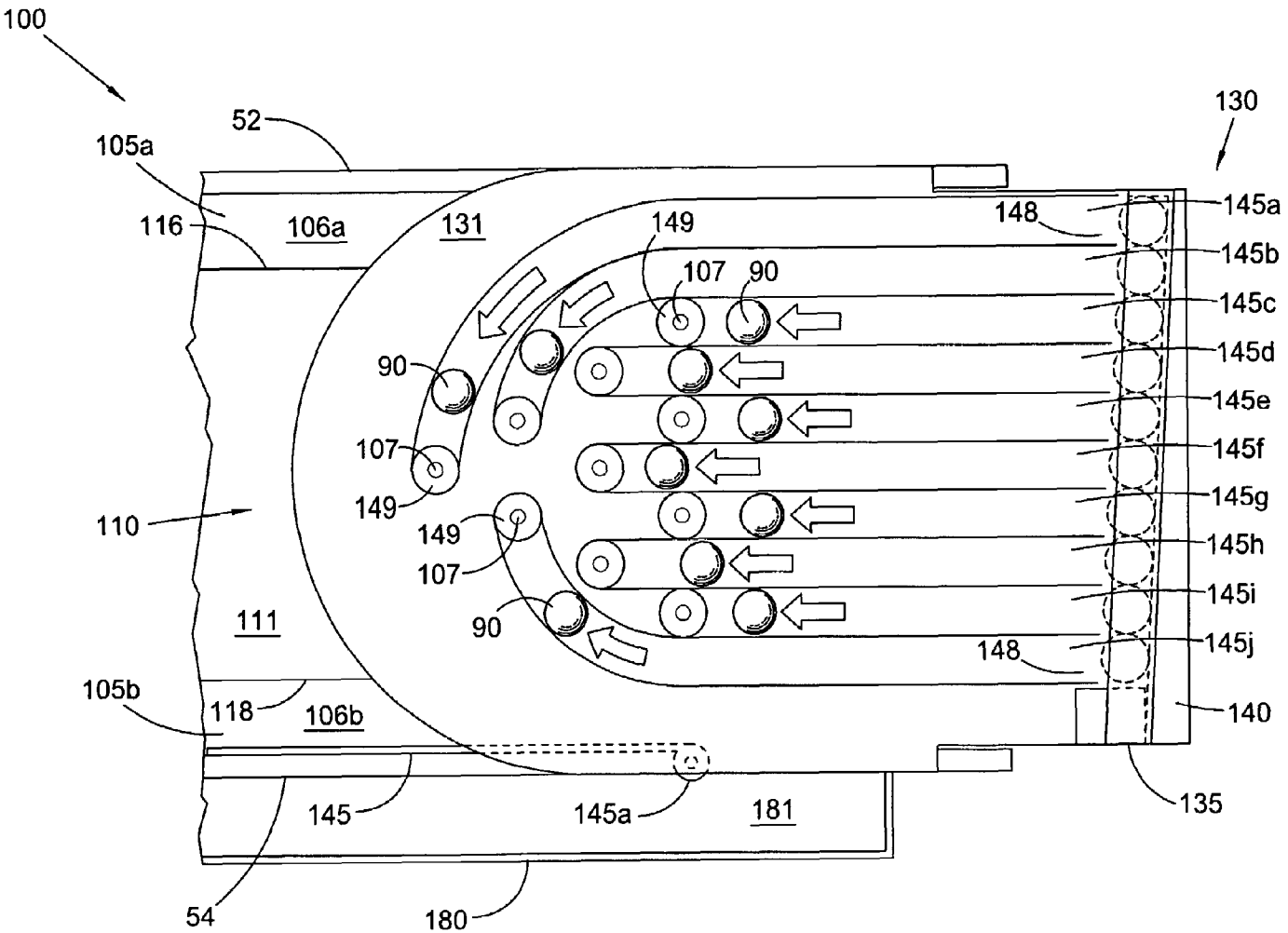
FIG. 8 is a partial top view of the gaming device, showing the target setter in the second position and the plurality of targets being directed along a plurality of channels of the target setter.

When planar surface 111 declines from first end 112 to second end 114, gaming device 100 preferably includes at least one positioning means, or positioning structure, operatively arranged to maintain a substantially spherical object, such as target 90, in a fixed position on playing field 110. As the game for which gaming device 100 is adapted involves a plurality of targets 90 arranged as a tetractys, a plurality of such positioning means or structures may be included. For example, as shown in FIGS. 5, 7, and 8, gaming device 100 may include a plurality of recesses 107 arranged as a tetractys in planar surface 111. Each recess 107 comprises a depressed surface arranged to engage a portion of the outer surface of a single target 90, such that target 90 is inhibited from rolling unless acted upon by an outside force. As shown in FIG. 2, the outside force may be provided by the collision of the resting target 90 with projectile 80, swing arm 145, or other targets 90.

In an alternative embodiment, the aforementioned positioning means, or positioning structure, may comprise a layer of textured material arranged on planar surface 111. Such textured material preferably provides a frictional engagement with targets 90 sufficient to inhibit them from rolling unless acted upon by an outside force. Such textured material may be any suitable material, for example, felt. Additionally, such positioning means, or positioning structure may include a plurality of recesses (not shown) arranged in the outer surface of each target 90, similar to those found in a standard golf ball, and which provide an irregular surface operatively arranged to inhibit target 90 from rolling unless acted upon by an outside force.

Planar surface 111 may be any suitable shape, for example, a circle, an oval, a trapezoid, etc. When gaming device 100 is adapted for the particular game shown and described herein, planar surface 111 is substantially rectangular and includes two longitudinal sides, namely, left side 116 and right side 118, each of which extend between first end 112 and second end 114. Accordingly, when planar surface 111 is rectangular, its length is determined by the length of left and rights sides, 116 and 118, respectively, and its width is determined by the length of first and second ends, 112 and 114, respectively.

Gaming device 100 may include one or more gutters arranged adjacent to and elevationally lower than planar surface 111, which are operatively arranged to direct a substantially spherical object from first end 112 toward second end 114, and preferably into receptacle 160 when included. As shown in the figures, gaming device 100 includes left gutter 105*a* arranged adjacent to and elevationally lower than left side 116, and right gutter 105*b* arranged adjacent to and elevationally lower than right side 118.

Left gutter 105*a* comprises surface 106*a* which declines as it extends along left side 116 from first end 112 to second end 114, and is, therefore, operatively arranged to direct a substantially spherical object from first end 112 to second end 114 and into receptacle 160, by means of gravity. Likewise, right gutter 105*b* comprises surface 106*b* which declines as it extends along right side 118 from first end 112 to second end 114, and is, therefore, operatively arranged to direct a substantially spherical object from first end 112 to second end 114 and into receptacle 160, by means of gravity.

Left and right gutters, 105*a* and 105*b*, respectively, may each comprise separate structures secured to playing field 110 along left and right sides, 116 and 118, respectively. However, in the embodiment shown in the figures, left gutter 105*a* is defined, at least in part, by left side wall 52, left side 116, and declined surface 106*a*. Likewise, right gutter 105*b* is defined, at least in part, by right side wall 54, right side 118, and declined surface 106*b*.

As stated supra, the present invention gaming device may comprise a receptacle arranged at one end of the playing field. In general, the function of the receptacle is to receive balls, i.e., projectile 80, targets 90 and/or objects 85, as they roll or fall from the playing field, and to direct them either to the target setter, in the case of targets 90, or back to the player, in the case of projectile 80.

In the embodiment shown in the figures, receptacle 160 comprises an open-topped compartment arranged adjacent to and elevationally lower than second end 114, so that planar surface 111 and left and right gutters, 105*a* and 105*b*, may direct one or more substantially spherical objects therein. Receptacle 160 preferably comprises at least one declined surface operatively arranged to direct a substantially spherical object into reservoir 140 of target setter 130. In the embodiment shown in the figures, receptacle 160 comprises front wall 164, left wall 168, back wall 162, and bottom wall 169, with left wall 168 being integral with left side wall 52 of the housing.

Figure 12:
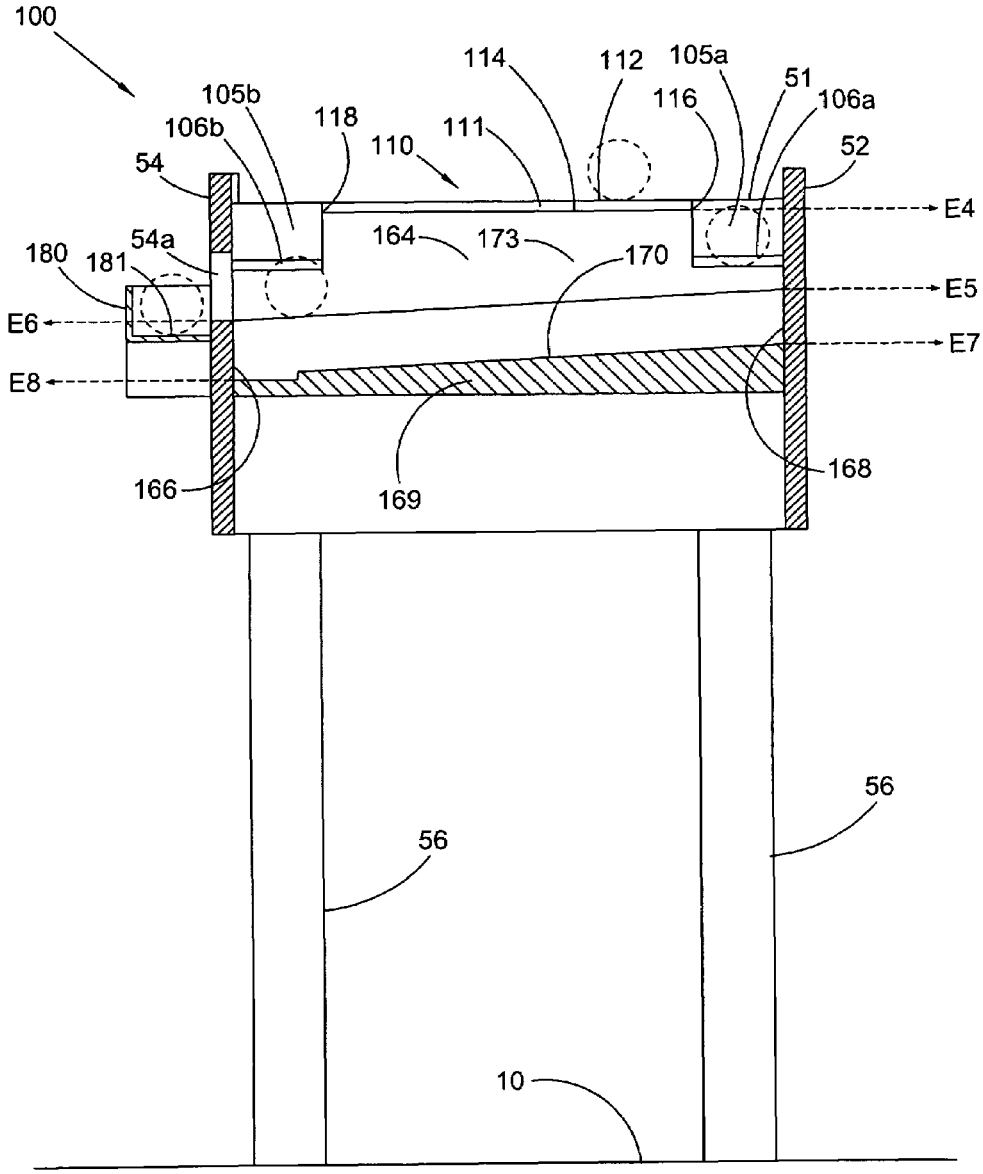
FIG. 12 is a back, elevational cross-sectional view of the gaming device taken generally along line 12-12 shown in FIG. 10; and, FIG. 13 is a back, elevational, cross-sectional view of the gaming device taken generally along line 13-13 shown in FIG. 10.

Front wall 164 comprises first declined surface 173, which declines as it extends from second end 114 and left and right gutters, 105*a* and 105*b*, toward bottom wall 169. Thus, front wall 164 is operatively arranged to direct a substantially spherical object from planar surface 111 and left and right gutters, 105*a* and 105*b*, toward bottom wall 169 by means of gravity. As shown in FIG. 12, first declined surface 173 also declines from elevation E5 to elevation E6 as it extends from left side wall 52 toward right side wall 54. Thus, front wall 164 is operatively arranged to direct a substantially spherical object from left side wall 52 toward right side wall 54.

Back wall 162 comprises second declined surface 175, which declines toward bottom wall 169 and, thus, is operatively arranged to direct a substantially spherical object toward bottom wall 169 by means of gravity. Similar to first declined surface 173, although not shown in the figures, second declined surface 175 also declines, preferably from elevation E5 to elevation E6, as it extends from left side wall 52 toward right side wall 54. Thus, second declined surface 175 is also operatively arranged to direct a substantially spherical object from left side wall 52 toward right side wall 54.

Figure 3:
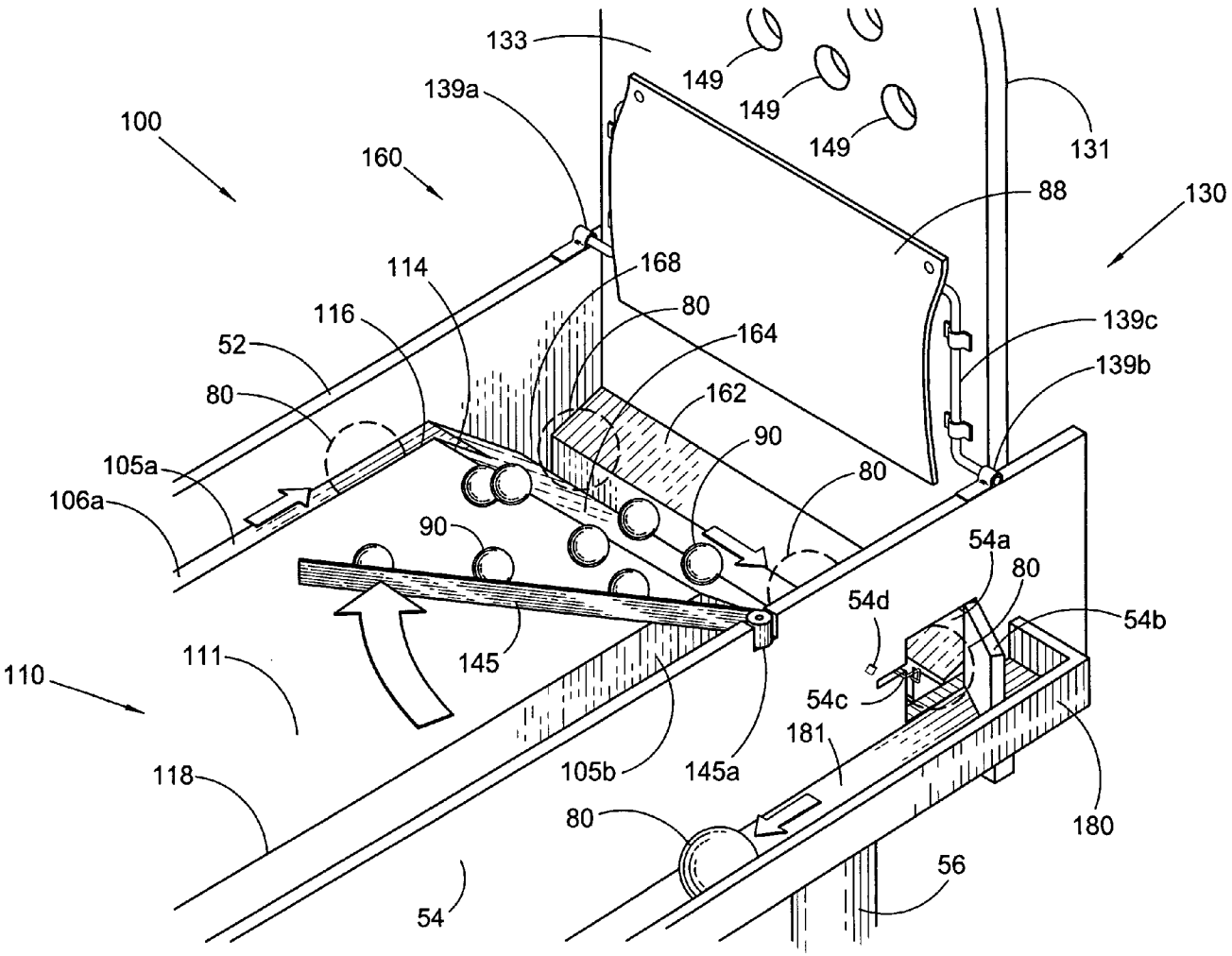
FIG. 3 is a front, partial perspective view of the gaming device, showing the plurality of targets being swept from the playing field and into the receptacle, and the projectile being directed along a return channel of the gaming device.

In the embodiment shown in the figures, right side wall 54 includes aperture 54*a* having door 54*b* therein arranged at elevation E6 proximate to where first and second declined surfaces, 173 and 175, respectively, meet right side wall 54. Thus, first and second declined surfaces, 173 and 175, are operatively arranged to direct a substantially spherical object from left side wall 52 to right side wall 54 and through 54*a*. In some embodiments of the invention, door 54*b* is retained in a closed position by locking means 54*c*, and such locking means is released as a projectile contacts release button 54*d*. It should be appreciated that locking means 54*c* and release button 54*d* may comprise a simple mechanical connection therebetween, or may comprise a more complex electronic activated actuator system, and such embodiments are within the spirit and scope of the claimed invention. Furthermore, locking means 54*c* may be a simple metal tab (as shown in the figures), an electro-magnetic lock or some other means known in the art for maintaining a door in a closed position, while release button 54*d* may be a mechanical device, an electric switch or some other actuation system known in the art. Moreover, door 54*b* may include a spring-loaded hinge whereby the door is restored to a closed position after an object passes therethrough. In this embodiment, gaming device 100 also includes return channel 180 extending generally from beneath aperture 54*a* toward front wall 57 along the outside of right side wall 54. Return channel 180 includes surface 180*a*, which declines as it extends from aperture 54*a* toward front wall 57 and, thus, is operatively arranged to direct a substantially spherical object from aperture 54*a* toward front wall 57 by means of gravity. Aperture 54*a* preferably has a diameter greater than or equal to diameter D1 of projectile 80, in order for first and second declined surfaces 173 and 175, respectively, to direct projectile through aperture 54*a* and into return channel 180, which then directs projectile 80 toward front wall 57, as shown in FIG. 3.

Bottom wall 169 provides the aforementioned at least one declined surface operatively arranged to direct a substantially spherical object into reservoir 140 of target setter 130. In particular, as shown in FIG. 12, bottom wall 169 comprises third declined surface 170, which declines from elevation E7 to elevation E8 as it extends from left side wall 52 toward right side wall 54 and, thus, is operatively arranged to direct a substantially spherical object from left side wall 52 to right side wall 54 by means of gravity.

In one embodiment, receptacle 160 includes exit portal 163, which may be in the form of an opening in back wall 162, arranged at elevation E8 proximate to where third declined surface 170 meets right side wall 54. Thus, third declined surface 170 is operatively arranged to direct a substantially spherical object from left side wall 52 to right side wall 54 and through exit portal 163. As described in detail infra, and shown in FIG. 4, third declined surface 170 is arranged to direct a substantially spherical object through exit portal 163, through cutaway 135, and into reservoir 140 of target setter 130, when target setter 130 is in a first (target receiving) position. It should be appreciated that other embodiments of declined surface 170 are also possible, e.g., the end of declined surface 170 that is furthest from cutaway 135 may be raised to dislodge occasional clogging of target balls, and such variations are within the spirit and scope of the claimed invention.

In a preferred embodiment, the distance between front and back walls, 162 and 164, respectively, is less than diameter D1 of projectile 80, so that projectile 80 cannot fit between front and back walls 162 and 164, respectively, and, therefore, cannot be directed by first and second declined surfaces 173 and 175, respectively, to third declined surface 170. However, the distance between front and back walls 162 and 164, respectively, is preferably greater than or equal to diameter D2 of target 90, so that the plurality of targets 90 can be directed by first and second declined surfaces 173 and 175, respectively, to third declined surface 170, which then directs them through exit portal 163 and into reservoir 140.

In general, the function of the target setter of the present invention is to provide a compartment arranged to collect and store a plurality of balls, e.g., targets 90, to guide them from the compartment to the playing field through one or more channels, and to arrange them on the playing field. It should be appreciated that the term "channel" refers to any trench, furrow, groove, tubular passage, or conduit along which a substantially spherical object may roll. It should be appreciated that various embodiments of the reservoir and channels have been contemplated and are within the scope and spirit of the invention. For example, the plurality of channels may comprise a plurality of tubes extending from the reservoir.

In the embodiment shown in the figures, target setter 130 comprises reservoir 140 and a plurality of channels, namely, channels 145*a-j*, extending from reservoir 140, as shown in FIGS. 5-9. Reservoir 130 is operatively arranged to collect and store a plurality of targets 90, and channels 145*a-j* are operatively arranged to guide a plurality of targets 90 from reservoir 140 to playing field 110, and to arrange and/or position them on playing field 110.

In this embodiment, target setter 130 comprises substantially planar panel 132, which includes first side 131, second side 133, and opening 135 arranged proximate and in communication with reservoir 140. Channels 145*a-j* are defined by first side 131 and a plurality of walls 134*a-k* arranged on first side 131. Each channel includes first orifice 148 arranged at one end of the channel, and second orifice 149 arranged at the opposite end of the channel. The plurality of first orifices 148 are aligned along, and are in communication with, reservoir 140. In the embodiment shown in the figures, the plurality of second orifices 149 are defined by panel 132 and are arranged as a tetractys.

Reservoir 140 is adapted to receive and store at least one, but preferably a plurality of, substantially spherical objects, such as, a plurality of targets 90. In the embodiment shown in the figures, reservoir 140 comprises a trough arranged on first surface 131 and including bottom surface 140*a*. It should be appreciated that the term "trough" refers to any long, narrow, open receptacle, which may be boxlike in shape. A trough or trough-like structure is preferable as it is operatively arranged to store a plurality of substantially spherical objects, such as targets 90, in a straight line, the import of which is described in detail infra.

Target setter 130 is pivotably coupled to playing field 110, i.e., it is operatively arranged to pivot relative to playing field 110 and, in particular, relative to planar surface 111. Target setter 130 may be pivotably coupled to playing field 110 by any suitable means. As shown in the figures, for example, target setter 130 is hingedly attached to left and right side walls, 52 and 54, respectively, by means of hinges 139*a* and 139*b*. FIGS. 1, 3-5, 7, 10, and 13 show target setter 130 in a first position, also referred to herein as the "target receiving" position. FIGS. 6, 8, 9, and 11 show target setter 130 in a second position, also referred to herein as the "target setting" position. Target setter 130 is operatively arranged to pivot between the target receiving position and the target setting position.

Figure 13:
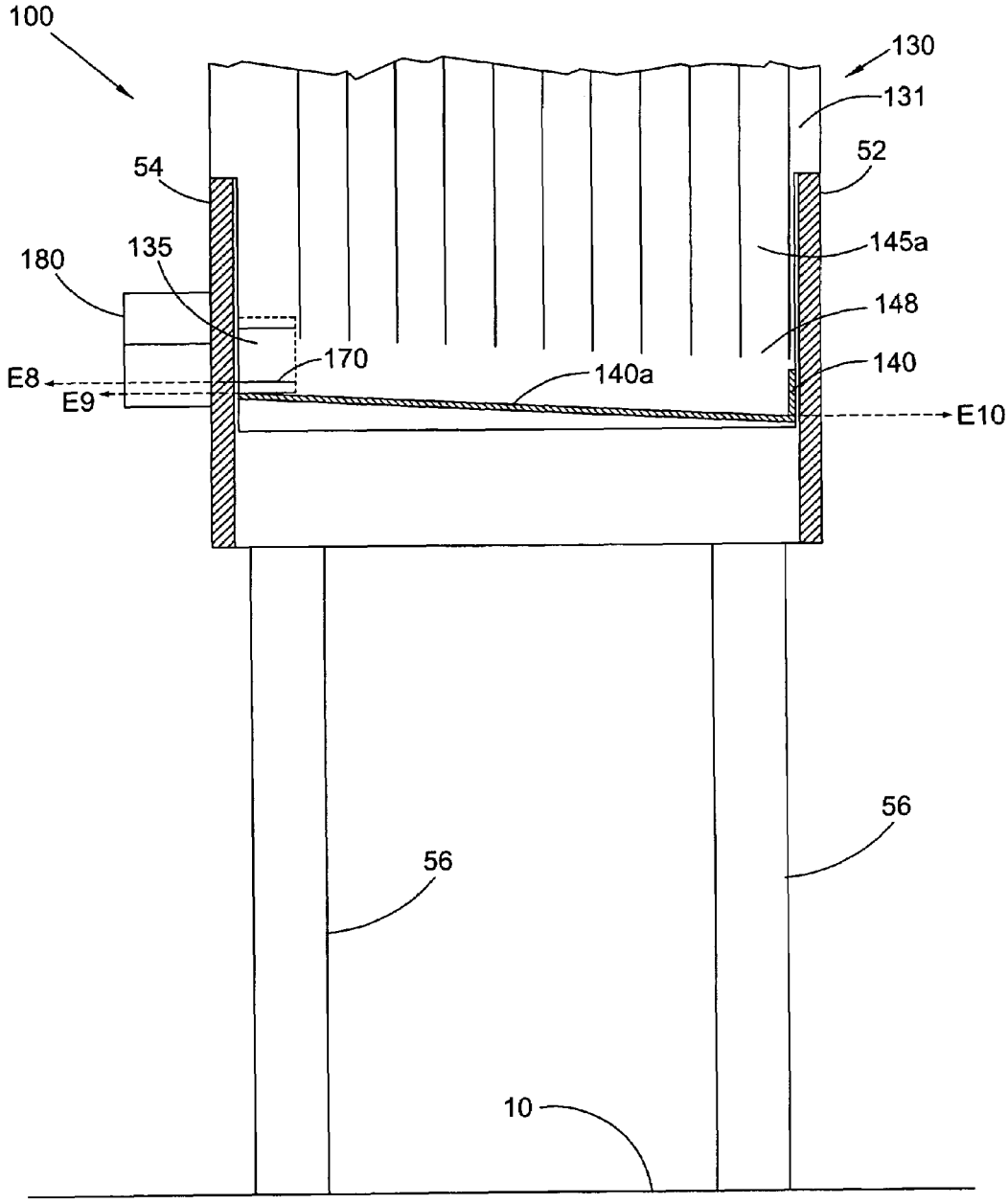

When target setter 130 is in the target receiving position, channels 145*a-j* extend upwardly from reservoir 140, i.e., channels 145*a-j* are arranged elevationally higher than reservoir 140, and reservoir 140 is arranged elevationally lower than playing field 110. In particular, as shown in FIGS. 12 and 13, when target setter 130 is in the target receiving position, second end 114 or planar surface 111, the elevationally lower end, is arranged at elevation E4, and reservoir 140 is arranged between elevations E9 and E10, which are elevationally lower than elevation E4. Additionally, when target setter 130 is in the target receiving position, bottom surface 140*a* of reservoir 140 declines as it extends from right side wall 54 toward left side wall 52. Thus, bottom surface 140*a* is operatively arranged to direct substantially spherical objects therein from right side wall 54 toward left side wall 52, and store them in a line, as shown in FIG. 5.

Figure 4:
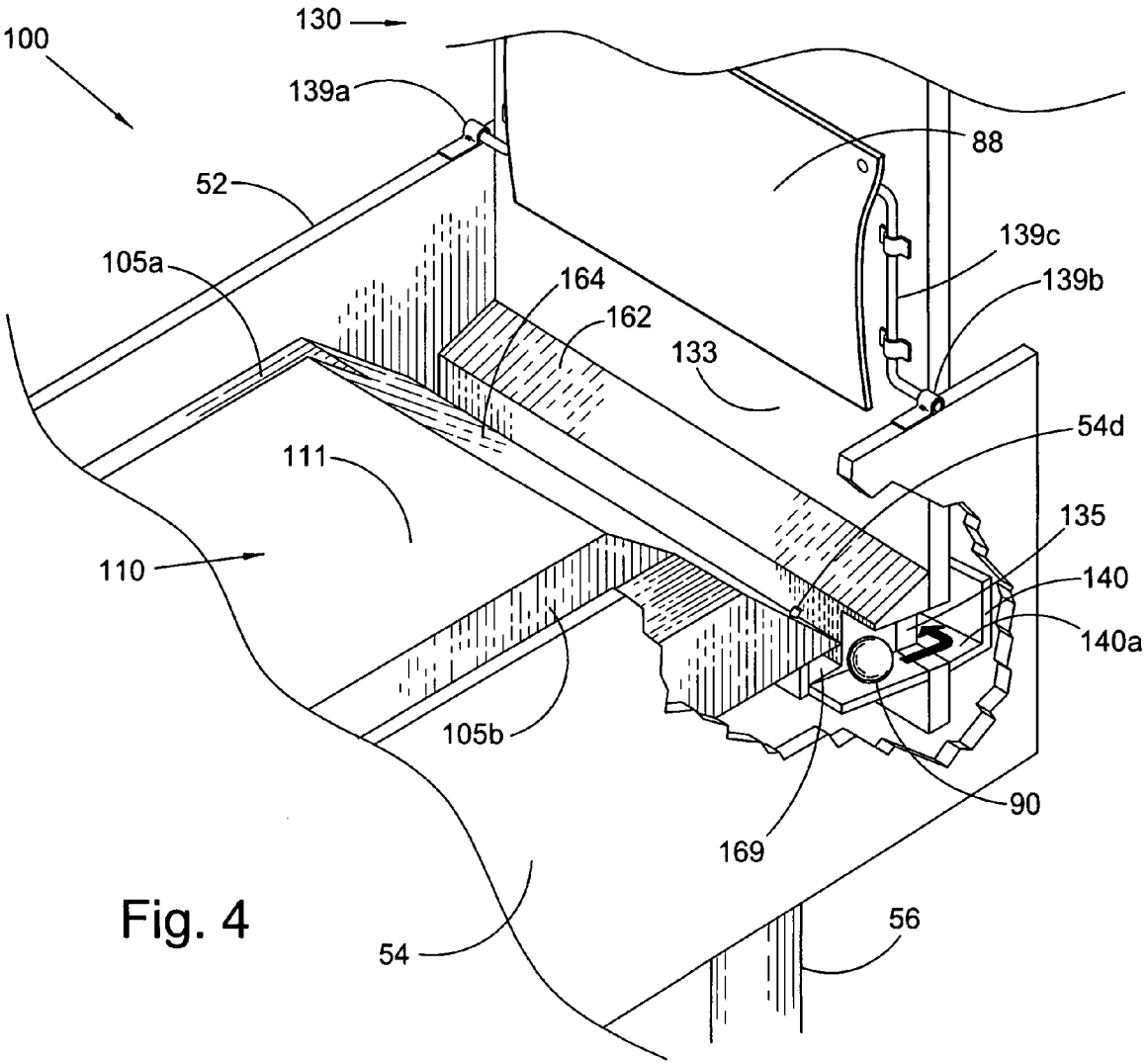
FIG. 4 is a front, partial perspective, cutaway view of the gaming device, showing a single target being directed from the receptacle and into a reservoir of the target setter.

When target setter 130 is in the target receiving position and gaming device 100 comprises receptacle 160, opening 135 is in alignment with exit portal 163, and bottom surface 140*a* is arranged elevationally lower than third declined surface 170. Moreover, as shown in FIGS. 4 and 5, when target setter 130 is in the first position and receptacle 160 is included, third declined surface 170 is operatively arranged to direct one or more substantially spherical objects through exit portal 163, through opening 135, and into reservoir 140. Reservoir 140, therefore, is operatively arranged to receive one or more substantially spherical objects indirectly from playing field 110 or directly from receptacle 160, when the target setter is in the first (target receiving) position. In other words, reservoir 140 is adapted to store a plurality of substantially spherical objects, and to store them in a line.

Figure 11:
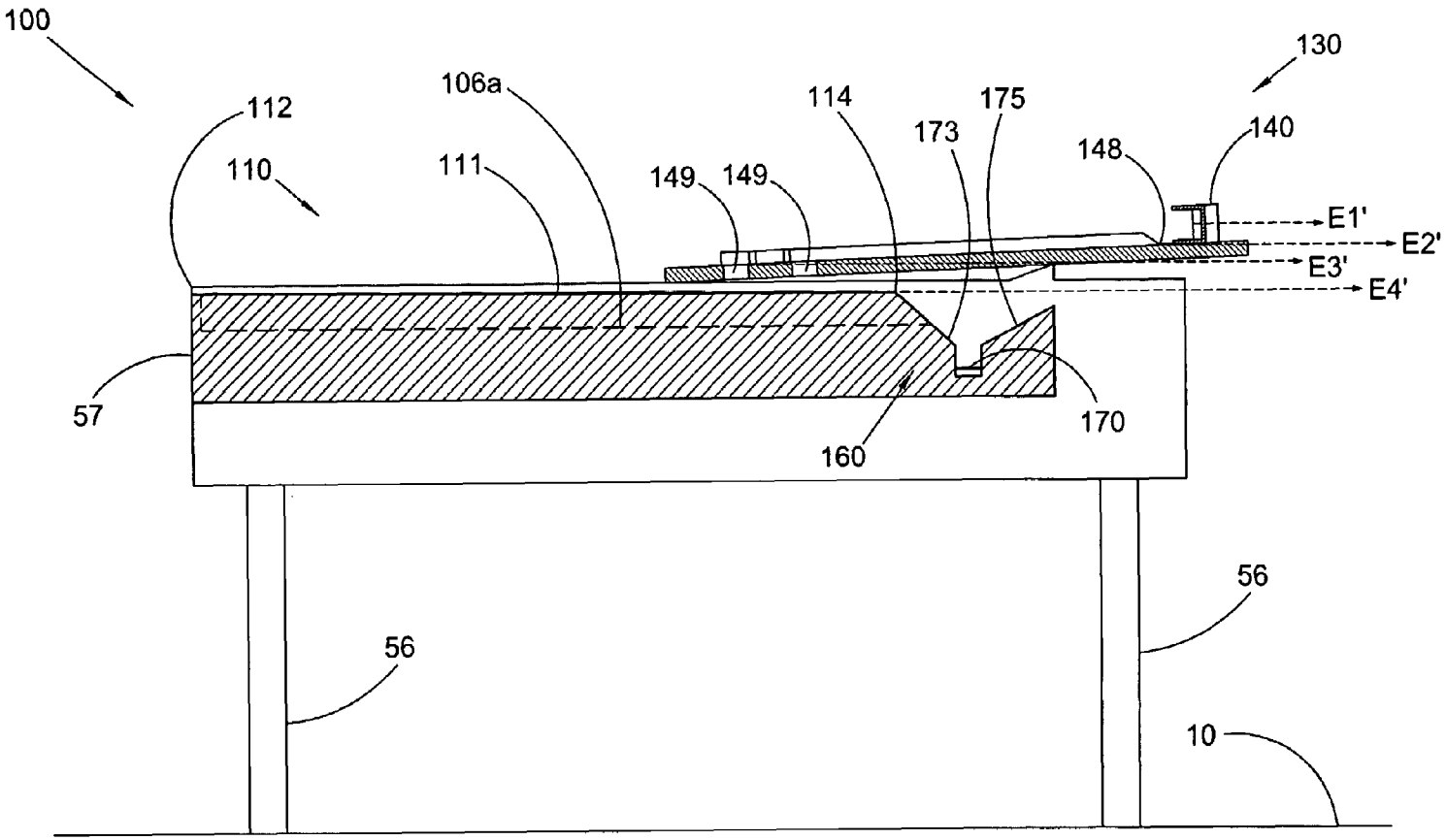
FIG. 11 is a right side, elevational, cross-sectional view of the gaming device taken generally along line 11-11 shown in FIG. 1, but with the target setter in the second position.

When target setter 130 is in the target setting position, channels 145*a-j* extend downwardly from reservoir 140, i.e., channels 145*a-j* are arranged elevationally lower than reservoir 140. In particular, as shown in FIG. 11, when target setter 130 is in the target setting position, reservoir 140 is arranged at elevation E1, first orifice 148 is arranged at elevation E2, which is elevationally lower than elevation E1, second orifice 149 is arranged at elevation E3, which is elevationally lower than elevation E2, and planar surface 111 is arranged at elevation E4, which is elevationally lower than elevation E3.

Additionally, when target setter 130 is in the target setter position, second orifices 149 are arranged directly above planar surface 111. Preferably, the portion of each channel which defines its second orifice is arranged substantially vertically so that a substantially spherical object will pass therethrough, and onto the playing field, at an approximately right angle relative to the force of gravity. Otherwise, the object may roll away from its intended position on the playing field. Since second orifices 149, as shown in the figures, are defined by substantially cylindrical bores in panel 132, the inner annular surface of the bores, along with the portion of walls 134*a-k* proximate thereto, provide such vertically arranged portion.

Figure 6:
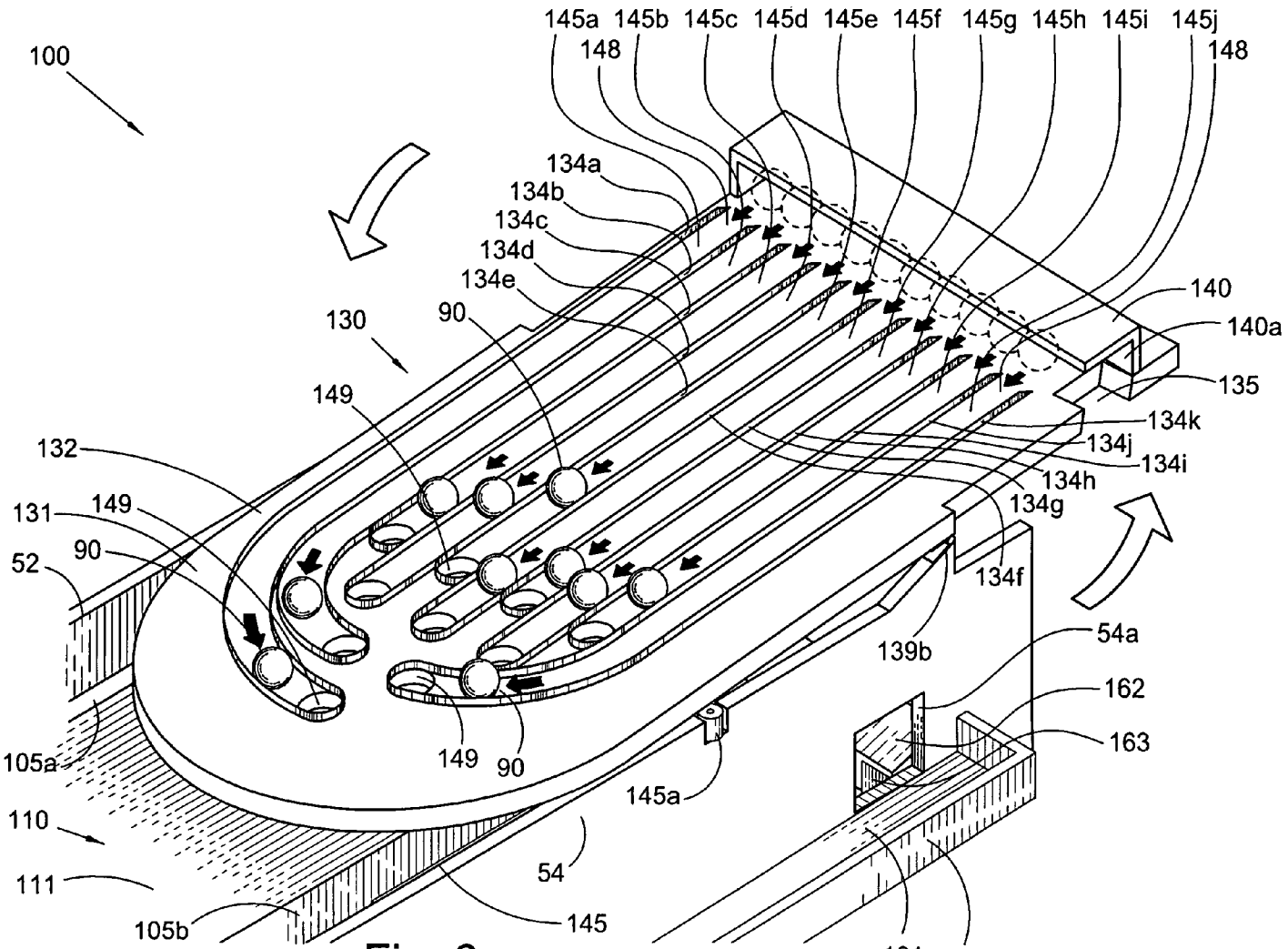
FIG. 6 is a front, partial perspective view of the gaming device, showing the target setter pivoting from a first position to a second position.
Figure 9:
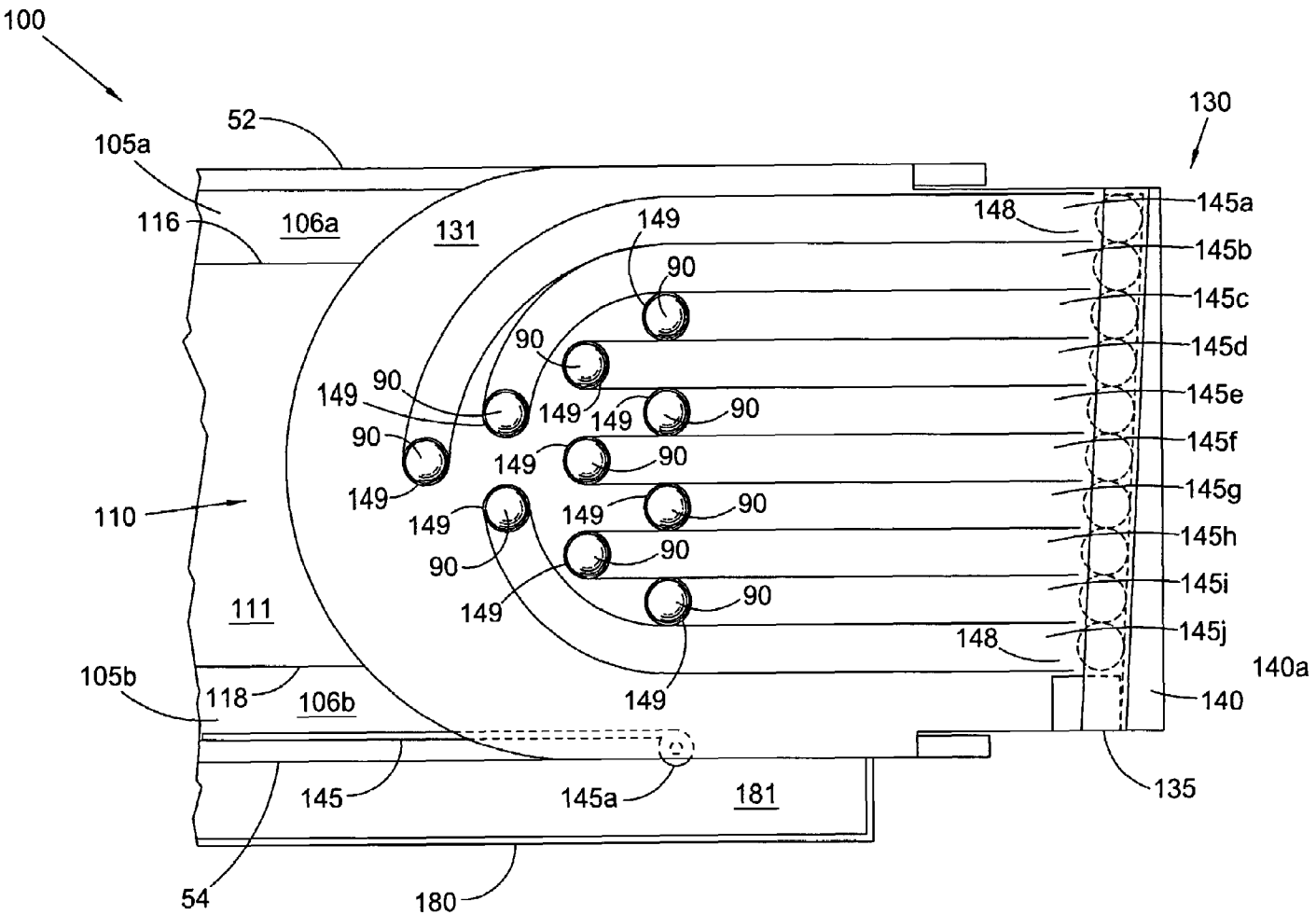
FIG. 9 is a partial top view of the gaming device, showing the target setter in the second position and the plurality of targets resting on the playing field.
Figure 10:
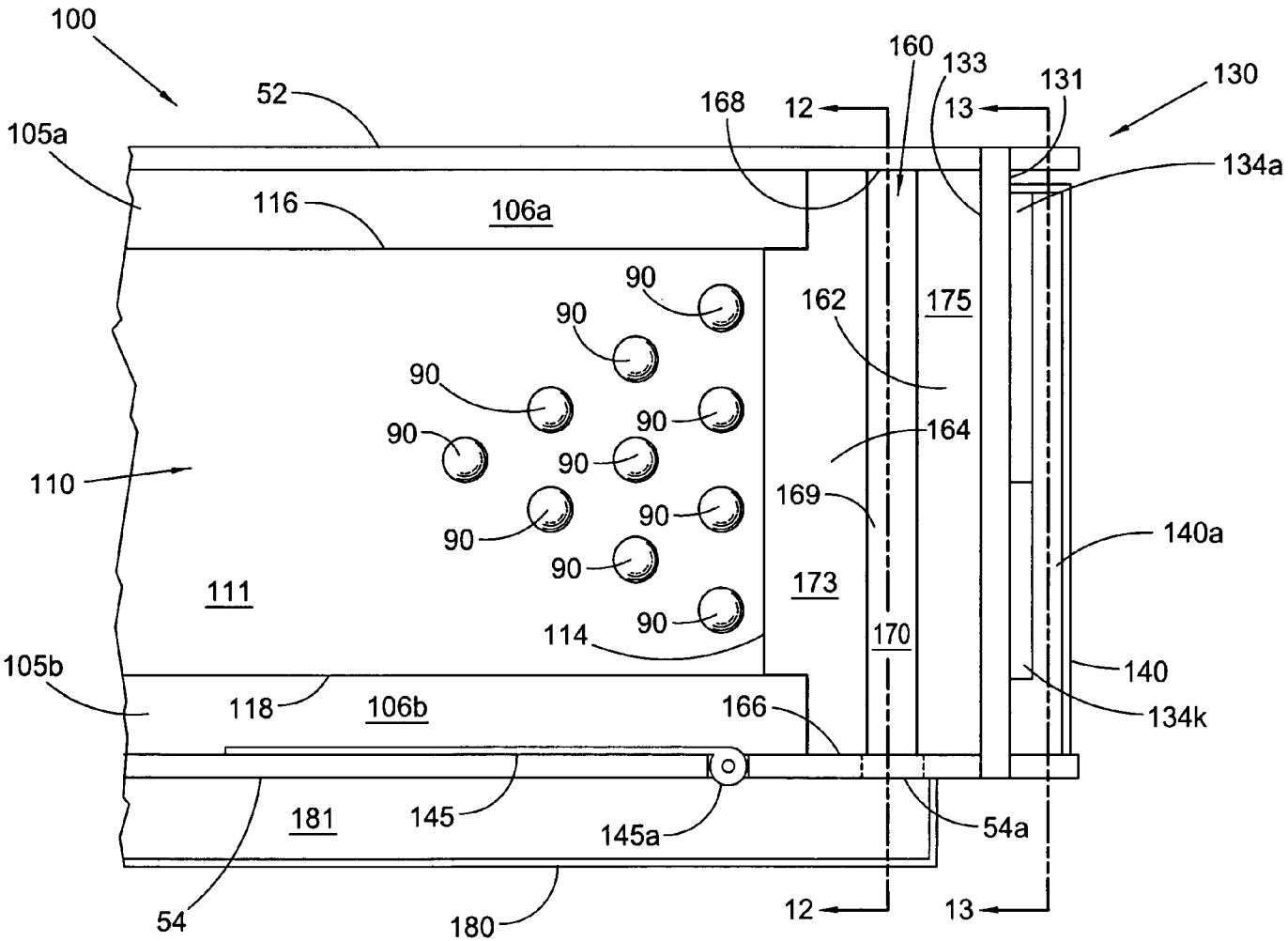
FIG. 10 is a partial top view of the gaming device, showing the target setter in the first position and the plurality of targets resting on the playing field.

Thus, as shown in FIGS. 6, 8, and 9, when target setter 130 is in the target setting position: reservoir 140 is operatively arranged to direct a plurality of substantially spherical objects, e.g., targets 90, into first orifices 148 of channels 145*a-j*; channels 145*a-j* are operatively arranged to direct targets 90 from first orifices 148 through second orifices 149 and onto playing field 110, by means of gravity. As shown in FIG. 8, when recesses 107 are included, second orifices 149 are arranged directly above them when target setter 130 is in the target setting position, so that targets 90 are directed onto recesses 107 which, as described supra, maintain their position on playing field 110. Once targets 90 are arranged on playing field 110 by target setter 130, target setter 130 may be pivoted back to the target receiving position, in order to for reservoir 140 to be in a position to collect and store targets again.

It has also been contemplated to arrange the present invention approximately fourteen inches off the ground and use the device as a skeeball like game is used. In such an embodiment, projectile 80 is lifted up to a comfortable level for a user of the device, e.g., as a return mechanism of a conventional pin bowling game.

It should be appreciated that some embodiments of the present invention also comprise a scoring device, a cover portion over the gaming device playing field, illumination of the target area, and/or non-spherical projectiles/target, e.g., object 85 described supra, and such embodiments are within the spirit and scope of the claimed invention.

In view of the foregoing, the present invention broadly comprises a pinball bowling gaming device. The pins of a conventional bowling game have been replaced by the target described supra, and in some embodiments, resemble the balls used in conventional pinball gaming devices.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A gaming device comprising:

a playing field including a substantially planar surface; and, a target setter arranged to pivot relative to the playing field between a first position and a second position, the target setter comprising a reservoir and at least one channel extending from the reservoir, wherein the reservoir is adapted to receive and store at least one substantially spherical object therein when the target setter is in the first position, and the at least one channel is operatively arranged to direct a substantially spherical object from the reservoir to the playing field when the target setter is in the second position.

2. The gaming device recited in claim 1 wherein the target setter comprises a plurality of channels extending from the reservoir, and each channel of the plurality of channels is operatively arranged to direct a substantially spherical object from the reservoir to the playing field when the target setter is in the second position.

3. The gaming device recited in claim 2 wherein each channel of the plurality of channels includes a first orifice arranged at one end of the channel proximate to the reservoir, and a second orifice arranged at an opposite end of the channel, and when the target setter is in the second position, the reservoir is arranged elevationally higher than each first orifice, each first orifice is arranged elevationally higher than each second orifice, and each second orifice is arranged elevationally higher than and directly above the playing field.

4. The gaming device recited in claim 3 wherein the reservoir is operatively arranged to store a plurality of substantially spherical objects in a line, the first orifices of the plurality of channels are arranged in line along the reservoir.

5. The gaming device recited in claim 4 wherein the second orifices of the plurality of channels are arranged as a tetractys.

6. The gaming device recited in claim 1 wherein the reservoir is elevationally lower than the substantially planar surface when the target setter is in the first position, and the reservoir is elevationally higher than the substantially planar surface when the target setter is in the second position.

7. The gaming device recited in claim 1 wherein the at least one channel is operatively arranged to direct a substantially spherical object from the reservoir to the playing field when the target setter is in the second position by means of gravity.

8. The gaming device recited in claim 1 further comprising a receptacle arranged adjacent to and elevationally lower than the substantially planar surface, wherein the receptacle is operatively arranged to receive one or more substantially spherical objects from the playing field and direct at least one substantially spherical objects into the reservoir when the target setter is in the first position.

9. The gaming device recited in claim 8 wherein the receptacle includes an exit portal and a first declined surface operatively arranged to direct a substantially spherical object through the exit portal and into the reservoir by means of gravity, when the target setter is in the first position.

10. The gaming device recited in claim 9 wherein the target setter comprises a substantially planar panel having a first side arranged opposite a second side, wherein the reservoir is arranged on the first side and the at least one channel is defined by the first side and a plurality of walls arranged on the first side.

11. The gaming device recited in claim 9 wherein the reservoir is elevationally lower the first declined surface when the target setter is in the first position.

12. The gaming device recited in claim 8 wherein the substantially planar surface of the playing field includes a first end and a second end arranged opposite the first end, the gaming device further comprises a return channel extending along the playing field between the first end and the second end, the receptacle is arranged adjacent to and elevationally lower than the second end and includes a second declined surface operatively arranged to direct a substantially spherical object into the return channel, and the return channel is operatively arranged to direct a substantially spherical object from the second end toward the first end.

13. The gaming device recited in claim 12 wherein said return channel and said second declined surface are separated by a hinged door, said hinged door is retained in a closed position by a locking means and said locking means is released by contact between said substantially spherical object and a release button arranged proximate said hinged door.

14. The gaming device recited in claim 12 wherein the substantially planar surface includes a left side and a right side extending between the first end and the second end, and the gaming device further comprises a left gutter arranged adjacent to and elevationally lower than the left side and a right gutter arranged adjacent to and elevationally lower than the right side, and the left gutter and the right gutter are each operatively arranged to direct a substantially spherical object from the first end to the second end by means of gravity.

15. The gaming device recited in claim 1 wherein the target setter comprises a substantially planar panel having a first side arranged opposite a second side, wherein the reservoir is arranged on the first side and the at least one channel is defined by the first side and a plurality of walls arranged on the first side.

16. The gaming device recited in claim 1 wherein the at least one channel extends upwardly from the reservoir when the target setter is in the first position, and the at least one channel extends downwardly from the reservoir when the target setter is in the second position.

17. The gaming device recited in claim 1 further comprising a means for positioning at least one substantially spherical object on the playing field.

18. The gaming device recited in claim 17 wherein the means for positioning at least one substantially spherical object on the playing field comprises a recess arranged in the substantially planar surface.

19. The gaming device recited in claim 17 wherein the means for positioning at least one substantially spherical object on the playing field comprises a textured material arranged on the substantially planar surface.

20. The gaming device recited in claim 1 wherein the at least one substantially spherical object comprises a substantially cylindrical portion having a height, a cylinder diameter and an axially arranged opening therethrough, and further comprises a spherical portion having a spherical diameter disposed within said opening, said spherical diameter is less than said cylinder diameter.

* * * * *